United States Patent [19]

Blöchlinger

[11] 4,424,751

[45] Jan. 10, 1984

[54] ENTRY STAIRS FOR VEHICLES

[75] Inventor: Ernst Blöchlinger, Neuhausen, Switzerland

[73] Assignee: SIG Schweizerische Industrie-Gesellschaft, Neuhausen, Switzerland

[21] Appl. No.: 227,880

[22] Filed: Jan. 23, 1981

[30] Foreign Application Priority Data

Jan. 28, 1980 [CH] Switzerland ..... 644/80

[51] Int. Cl.[3] ..... B62D 23/02

[52] U.S. Cl. ..... 105/447; 280/166

[58] Field of Search ..... 105/447, 443, 444, 445, 105/446, 448, 449, 450, 430, 426, 432, 435, 436; 414/545, 921; 187/9 R; 280/163, -166; 296/62, 75, 178

[56] References Cited

U.S. PATENT DOCUMENTS

| | | | |
|---|---|---|---|
| 2,951,454 | 9/1960 | Candlin, Jr. | 105/447 |
| 3,408,959 | 11/1968 | Cripe et al. | 105/447 |
| 3,572,754 | 3/1971 | Fowler | 105/447 X |
| 3,651,767 | 3/1972 | Findeklee | 105/448 |
| 3,675,593 | 7/1972 | Tonne et al. | 105/447 |

FOREIGN PATENT DOCUMENTS

| | | | |
|---|---|---|---|
| 2129223 | 12/1972 | Fed. Rep. of Germany | 105/448 |
| 3004640 | 7/1981 | Fed. Rep. of Germany | 105/447 |

*Primary Examiner*—Joseph F. Peters, Jr.
*Assistant Examiner*—Mitchell J. Hill
*Attorney, Agent, or Firm*—Lawrence Rosen

[57] ABSTRACT

The lifting step of the entry stair for rail vehicles is guided on both sides by two parallel guide brackets and while staying parallel to an extendable and retractable vehicle floor, forms a shallow arc from one end position to the other. In its upper end position it is level with the vehicle floor. The vehicle door closes along its outer edge with an elastic door seal. The folding step turns around the turning axis. In the "up" position the folding step stands about vertically and, together with the covering plate attached to the lifting step, forms a flush covering apron completing the side wall of the vehicle. The angle of incline for the stairs, in general, might be about 40°. This stair system does not form any niches when in the "under way" position wherein ice and snow could accumulate. Nor does this stairway require additional covering parts such as movable covering aprons, etc.

7 Claims, 6 Drawing Figures

ENTRY STAIRS FOR VEHICLES

FIELD OF THE INVENTION

The invention here presented concerns an entry stair system for track or rail vehicles and for service with rail platforms of varying heights, equipped with at least two movable steps.

BACKGROUND OF THE INVENTION

In recent years there have been an increase in attempts, depending on the traffic and technical conditions of the rail vehicles in the various parts of cities, to combine the possibilities and properties of streetcars and subways in the same vehicles.

This requires entry steps for two different platform heights. As a rule, entry and exit on the streetcar routes are from and to a sidewalk or a sidewalk-like island using a stairway that is part of the vehicle; while on the subway routes there are high railway platform without any real step.

Movable steps are known, where the step-plate parts, which in their initial position comprise a part of the vehicle floor, go through an unfolding motion while being lowered. Riders, who mistakenly stand either entirely or partly on this plate, are thus exposed to an immediate danger of accident by either twisting an ankle or slipping outward on the slanting plate. Also, the devices used heretofore require a large amount of space in the direction of the width of the vehicle, so that problems result in mounting the apparatus below the vehicle floor between the step arrangements.

A further disadvantage of the previous systems and proposals used up to now consists of the fact that in the under-way position there are niches where, for example, snow can accumulate, or where special, movable covering aprons are additionally required.

BRIEF DESCRIPTION OF THE INVENTION

The entry stairway according to the present invention does not tend to form, in the under-way position niches in which snow and ice can accumulate, or require additional covering parts, such as movable covering aprons or some similar device. Such an entry stair is distinct in that the upper step can, as a lifting step, be lowered from its initial position, in which it is a part of the vehicle floor, roughly vertically and parallel to the vehicle floor by the height of one step.

DETAILED DESCRIPTION OF THE INVENTION

A model of the object of this invention is further explained with a drawing as follows.

Shown are the following:

FIG. 1. A frontal view of a rail car door with the stair swung in.

FIG. 2. A cross section along lines A—A of FIG. 1.

FIG. 3. A cross section along lines A—A of FIG. 1 with the stairs lowered.

FIG. 4. A cross section along lines B—B of FIG. 1 showing the drive mechanism of the lifting step.

FIG. 5. A cross section along lines C—C of FIG. 1 showing the drive mechanism of the folding stair.

FIG. 6. A cross section along lines D—D of FIG. 1 showing the activating mechanism.

FIG. 1. shows a view of the door 1 with the stair assembly 3 seen from the side of the vehicle. Here, also, the lines of the cross sections shown in the following figures are indicated.

The FIGS. 2 and 3 show cross sections through the plane A—A, and in FIG. 2 the position "up", which corresponds to the position while under way or exit and entry from and to a high railway platform (7).

FIG. 2 shows the movable elements of cross section A—A in the "up" position. FIG. 3 shows the same cross section with the movable elements in the "lowered" position, which enables one to enter via the two movable steps, i.e. via a stair made up of three steps.

Figure 4:
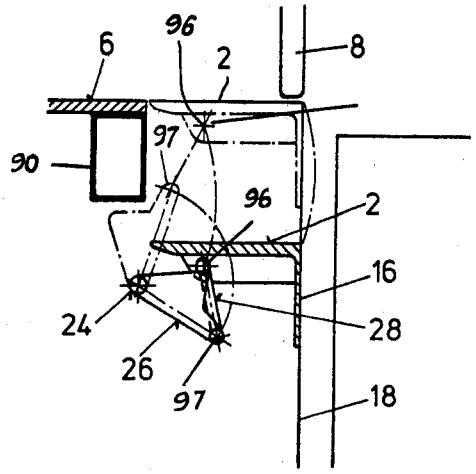
Figure 5:
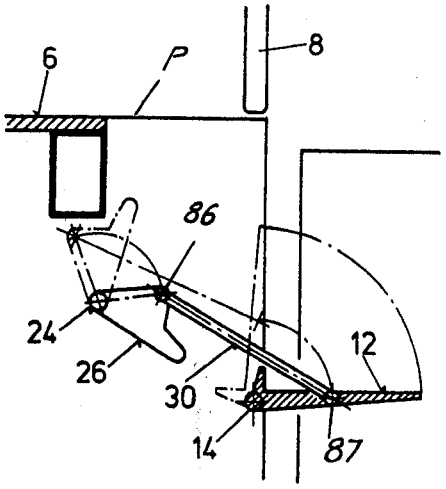
Figure 6:
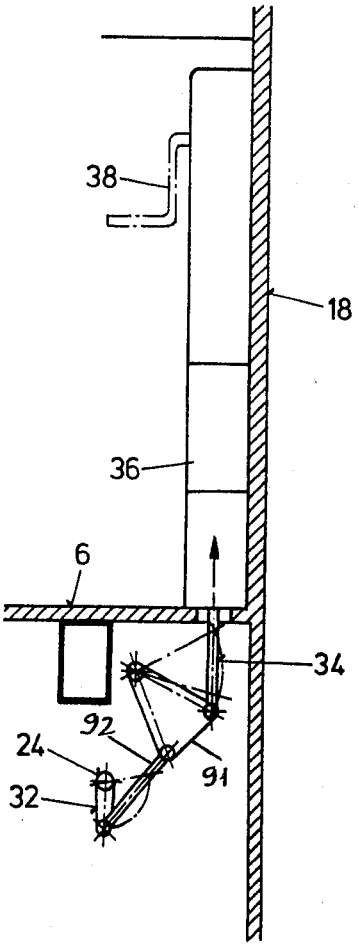

In FIGS. 4, 5 and 6 the "lowered" position is drawn out and shaded; the "up" position is outlined with dash and point.

FIG. 4 illustrates the drive for the lifting step 2.

FIG. 5 shows the drive mechanism for the folding step 12; and FIG. 6, shows the activating mechanism 34, 36, etc. mounted along and off to the side of the door 8, which turns the drive shaft 26 from one end position to the other.

The lifting step (2) is controlled or guided on both sides by two parallel guiding bracket mechanisms 4 mounted on pivot anchor 84. Therefore it describes, while staying parallel, a shallow or flat arc from one end to the other end position.

Figure 3:
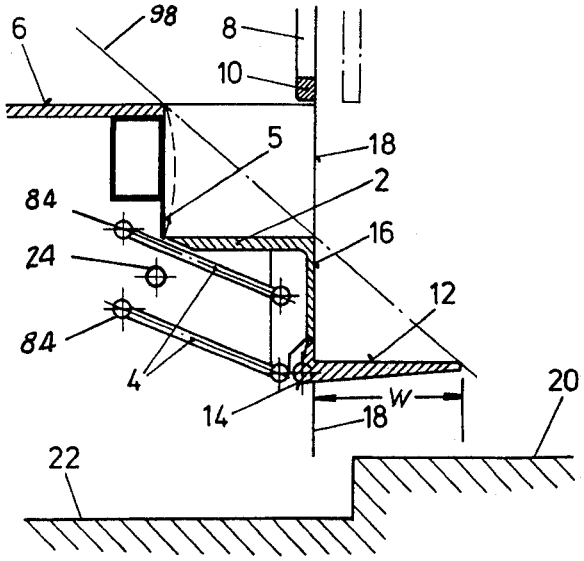

In its upper end position lifting step 2 is situated level with the floor of the vehicle (6), the latter being in horizontal plane P. The vehicle door (8) closes along its lower edge with an elastic door sealer (10). The folding step (12) of width (W) is rotated about the turning axis (14). In its "up" position folding step 12 is about vertical, and together with the covering plate (16) of the lifting step (2), forms an even apron, completing the sidewall (18) of the vehicle. The angle of incline of the stairs, indicated by line 98 (FIG. 3), can be chosen within wide margins, depending on available space and the requirements for ease of access. Generally, as a compromise for most operations, an angle of 40° is deemed desirable. FIG. 3 shows the "lowered" position, and the way in which entry can be effected in three steps from a sidewalk (20) which is slightly higher than the street and/or the upper edge of the rails (22) via the two step plates.

Figure 1:
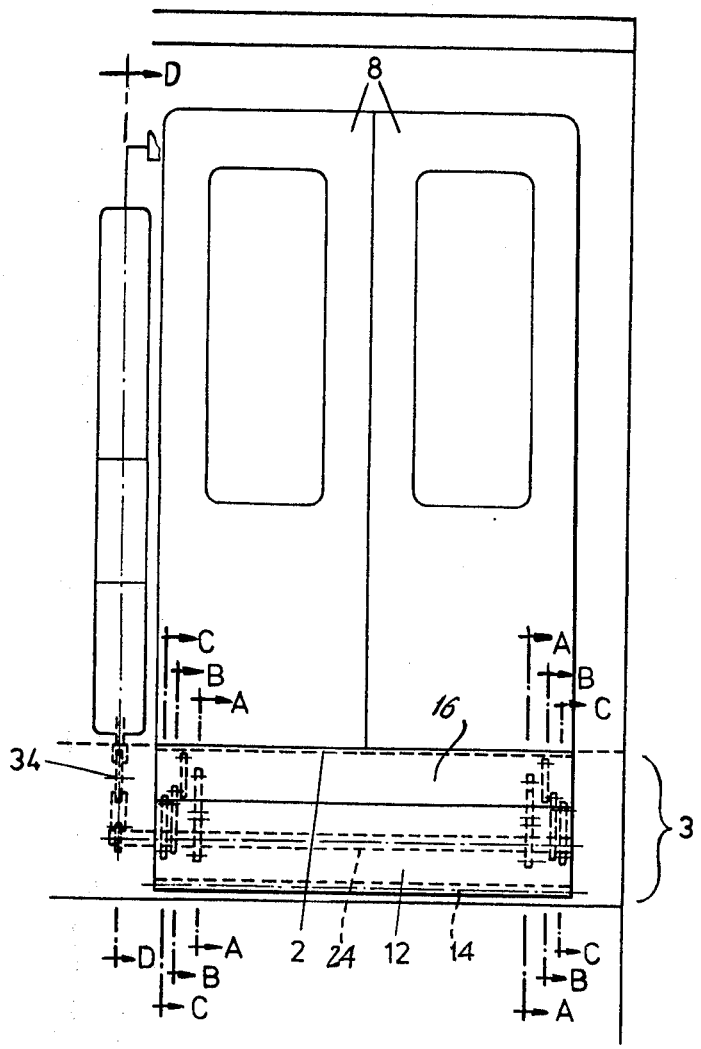
Figure 2:
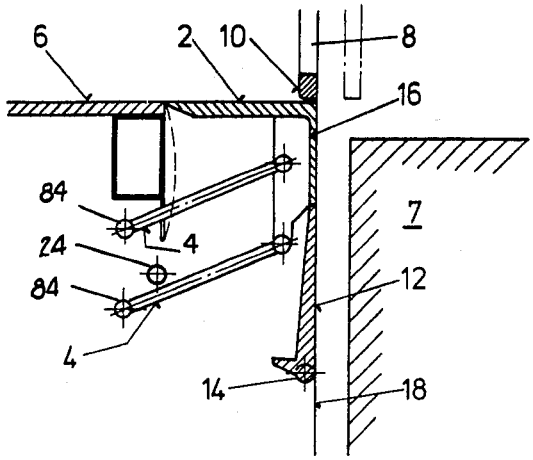
FIGS. 2 and 3 show the parallel guide brackets (4) controlling the lifting step in both end positions. The upper covering plate or riser 99, firmly mounted on the vehicle, which could be flat or, corresponding to the arched motion of the lifting step, slightly rounded.

FIG. 4 shows how the so-called toggle or knee-lever, consisting of turning bracket (26) attached to the drive shaft 24 and rod (28) extending between bracket 26 and step 2, moves the lifting step (2) from one position to the other. In the upper end position the dead center point position is exceeded somewhat. That is, pivot 97 where rod 28 connects with bracket 26 is a toggle knee that is over dead center by being to the left of an imaginary line extending between shaft 24 and pivot 96, the latter connecting rod 28 to step 2 as viewed in FIG. 4. This results in a secure support and avoids the creation of a backturning torque upon the drive shaft (24). FIG. 5 shows how another so-called toggle or knee-lever, consisting of the same turning bracket (26) and the rod (30) connected at knee 86 to bracket 26 and at pivot 87 to folding step (12) moves the latter between its raised (FIG. 2) and lowered (FIG. 3) positions. With step 12 in its raised position, toggle knee 86 is inboard of a vertical line extending through drive shaft 24. FIG. 6 shows the activation of the drive shaft (24) via the turning bracket

(32) and link 92, and, in this case for reasons of design, via an angle bracket 91 by the activating rod (34). The activating rod (34) can be moved up and down by pneumatic activation in form of an air pressure cylinder (36).

The possibility exists, in case of emergency, to move the same rod via an additional hand crank mechanism (38). However, electromechanical, electrohydraulic or other means are possible as well. The exact method of activation is not a critical aspect of the present invention and can be done according to known techniques.

Because the upper step 2 moves roughly vertically and stays parallel to the floor 6, the catching and crushing or slipping of the foot becomes impossible when someone stands on the upper step while it is being lowered. This upper step is always within the inside of the vehicle, hence there is no dangerous possibility for ice formation. Furthermore, the stair construction requires relatively little space in the vehicle. The longitudinal support beam 90, normally continued along the outside, has to be slightly relocated inward in the area of the stairs. Thereby enough space is saved for the necessary mechanisms in the stair region of the undercarriage, and no major modification for the preservation of longitudinal structural strength is necessary. The angle of incline of the stairs can be chosen according to the requirements for ease of access and the available space. In general, about 40 degrees or so could be a guideline. No special covering aprons for the completion of the sidewall under the door are required. The covering is accomplished via the covering plate 16 attached to the upper lifting step 2 and the lower folding step 12 when folded up, which form an even part of the vehicle's sidewall in the apron area when the steps are in the "under-way" position.

The various commonly used models of doors can be used in combination with the new stair system, and that is with normal door height. The operating mechanism, located for the most part below the lifting step, consists mostly of jointed levers, which do not tend to malfunction if they get dirty or ice covered. Finally, the possibility exists that in one or both end positions the upper lifting step 2 is supported by the lower step 12 via the covering plate which is attached to the lifting step.

What is claimed is:

1. Entry stairs for rail vehicles that are usable with rail platforms of varying height, said entry stairs including a first step and a second step below said first step, said first step when in an upper position being level with the floor of the vehicle and at that time said second step forming a part of the vertical side wall of the vehicle, said first step being mounted for movement from the upper position to a lower position for operation with relatively low rail platforms, said first step in moving between said upper and lower positions remaining generally horizontal, said second step being foldable between a generally vertical up position and a generally horizontal down position, a parallelogram-shaped pair of hinged guide brackets connected to said first step and guiding movement thereof so that said first step acts as a lifting step which executes essentially vertical motion only, a pivot means about which said second step moves between said up and down positions, said pivot means being firmly mounted on the vehicle and disposed at the lower end of the second step when it is in its said up position at which time said second step lies roughly in the plane of a side wall of a vehicle having said entry stairs.

2. Entry stairs according to claim 1 in which the second step when in its said down position extending outboard of the vehicle.

3. Entry stairs according to claim 1, also including a common drive shaft firmly mounted on the vehicle, first and second knee-lever means drivingly connected to the respective first and second steps at the middle regions thereof, said first and second knee-levers being drivingly connected to said drive shaft so that the first and second knee-lever means cannot rotate independently of each other.

4. Entry stairs according to claim 1 or 3 in which the parallelogram-shaped pair of hinged guide brackets are mounted on first and second pivot anchors roughly vertically one above the other, and the entire arc of motion of the parallelogram-shaped pair of guide brackets is roughly symmetrical to the horizontal.

5. Entry stairs according to claim 9 in which with the first step in said upper position the first knee-lever means is situated past its dead center point.

6. Entry stairs according to claim 1 in which the width of the second step is less than the distance between the plane of the vehicle floor and the pivot axis of the second step, a vertical covering plate firmly attached to the outer edge of the first step, and with the second step in the up position, said plate constituting a covering for a gap between the first and second steps.

7. Entry stairs according to claim 6 in which the first step is supported from below by the second step in engagement with the covering plate when said first step is in its said upper position.

* * * * *